US005263461A

United States Patent [19]

Fujimoto et al.

[11] Patent Number: 5,263,461

[45] Date of Patent: Nov. 23, 1993

[54] EVAPORATIVE FUEL-PURGING CONTROL SYSTEM FOR INTERNAL COMBUSTION ENGINES

[75] Inventors: Sachito Fujimoto; Fumio Hosoda; Masakazu Kitamoto; Kojiro Tsutsumi, all of Wako, Japan

[73] Assignee: Honda Giken Kogyo Kabushiki Kaisha, Tokyo, Japan

[21] Appl. No.: 922,422

[22] Filed: Jul. 31, 1992

[30] Foreign Application Priority Data

Aug. 2, 1991 [JP] Japan ..... 3-068461[U]

[51] Int. Cl.[5] ..... F02M 33/02; F02B 77/00

[52] U.S. Cl. ..... 123/520; 123/198 D

[58] Field of Search ..... 123/516, 518, 519, 520, 123/198 D, 494

[56] References Cited

U.S. PATENT DOCUMENTS

| | | | |
|---|---|---|---|
| 4,949,695 | 8/1990 | Uranishi et al. | 123/494 |
| 5,084,194 | 2/1992 | Kuroda et al. | 123/479 |
| 5,085,197 | 2/1992 | Mader et al. | 123/516 |
| 5,111,796 | 5/1992 | Ogita | 123/520 |
| 5,125,385 | 6/1992 | Frinzel | 123/698 |
| 5,139,001 | 8/1992 | Tada | 123/494 |
| 5,143,035 | 9/1992 | Kayanuma | 123/198 D |
| 5,176,123 | 1/1993 | Hosoda et al. | 123/520 |
| 5,178,117 | 1/1993 | Fujimoto et al. | 123/520 |

FOREIGN PATENT DOCUMENTS

| | | |
|---|---|---|
| 62-131962 | 6/1987 | Japan . |
| 63-111277 | 5/1988 | Japan . |

*Primary Examiner*—E. Rollins Cross
*Assistant Examiner*—Thomas Moulis
*Attorney, Agent, or Firm*—Nikaido, Marmelstein, Murray & Oram

[57] ABSTRACT

An evaporative fuel-purging control system for an internal combustion engine incorporates a flowmeter arranged across a purging passage for outputting an output value indicative of the flow rate of a mixture of evaporative fuel and air being purged through the purging passage. Abnormality of the flowmeter is determined, based on a value of the output value therefrom assumed when the purging of the gaseous mixture is stopped. Alternatively or in combination, abnormality of the flowmeter is determined, based on a value of the output value therefrom assumed when the purging of the gaseous mixture is resumed after stoppage thereof.

7 Claims, 8 Drawing Sheets

EVAPORATIVE FUEL-PURGING CONTROL SYSTEM FOR INTERNAL COMBUSTION ENGINES

BACKGROUND OF THE INVENTION

1. Field of the Invention

This invention relates to an evaporative fuel-purging control system for internal combustion engines, and more particularly to an evaporative fuel-purging control system for an internal combustion engine, which is adapted to control the flow rate of a gaseous mixture containing evaporative fuel purged into the intake system of the engine.

2. Prior Art

Conventionally, evaporative emission control systems have widely been used in internal combustion engines, which operate to prevent evaporative fuel (fuel vapor) from being emitted from a fuel tank into the atmosphere, by temporarily storing evaporative fuel from the fuel tank in a canister, and purging same into the intake system of the engine. Purging of evaporative fuel into the intake system causes instantaneous enriching of a total air-fuel mixture supplied to the engine. If the purged evaporative fuel amount is small, the air-fuel ratio of the mixture will then be promptly returned to a desired value, with almost no fluctuation.

However, if the purged evaporative fuel amount is large, the total air-fuel mixture supplied to the engine becomes very rich, so that the air-fuel ratio of the mixture may fluctuate. For example, a large amount of fuel vapor can be produced in the fuel tank immediately after refueling or fill-up. In order to prevent fluctuations in the air-fuel ratio due to purging of evaporative fuel (fuel vapor) on such an occasion, there has been proposed e.g. by Japanese Provisional Patent Publication (Kokai) No. 63-111277 a purging gas flow rate control system which reduces the purging amount of a mixture of evaporative fuel and air from the start of the engine immediately after refueling or fill-up until the speed of the vehicle in which the engine is installed reaches a predetermined value, and also reduces the purging amount of the mixture after the vehicle speed has reached the predetermined value and until the accumulated time period over which the vehicle speed exceeds the predetermined value reaches a predetermined value.

Further, an air-fuel ratio control system is also known e.g. from Japanese Provisional Patent Publication (Kokai) No. 62-131962, which forecasts an amount of possible variation of an air-fuel ratio correction coefficient caused by purging of a large amount of evaporative fuel, from an amount of variation of the air-fuel ratio correction coefficient actually caused by purging of a small amount of evaporative fuel, to thereby suppress fluctuation in the air-fuel ratio of the total mixture even when a large amount of evaporative fuel is purged.

However, the proposed conventional systems are liable to fail to perform accurate control of the air-fuel ratio since the actual flow rate of evaporative fuel is not detected by either of them in controlling the flow rate of a mixture purged.

Such inconveniences may be eliminated by providing a mass flowmeter in a purging passage and at the same time setting a desired flow rate of evaporative fuel based on operating conditions of the engine, whereby the opening of a purge control valve, which controls the purging, is controlled depending on an output value from the mass flowmeter and the desired flow rate of evaporative fuel to control the flow rate of the mixture purged.

According to this possible manner of eliminating the inconvenience described above, an accurate flow rate of evaporative fuel can be obtained since the flow rate of the mixture purged is directly measured by the flowmeter, which enables the air-fuel ratio control to be constantly effected in an accurate manner.

However, when the mass flowmeter becomes faulty or deteriorated in performance to output an abnormal value, the flow rate of the mixture purged is controlled based on such an abnormal value, which gives rise to the following problems:

If the output from the flowmeter indicates an abnormally small value, an excessively large amount of evaporative fuel is supplied to the engine in response thereto to cause the air-fuel ratio to be enriched to a large extent, which may result in stoppage of the engine or emission of noxious components, such as CO and HC, in large quantities. On the other hand, if the output from the flowmeter indicates an abnormally large value, an excessively small amount of evaporative fuel is supplied to the engine in response thereto to cause the air-fuel ratio to be leaned.

Further, in the above evaporative fuel-purging control, a vapor (evaporative fuel) flow rate-dependent correction coefficient for modifying the air-fuel ratio correction coefficient is calculated, and the opening of the fuel injection valves is controlled according to the fuel injection period calculated by the use of the air-fuel ratio correction coefficient thus modified. The vapor flow rate-dependent correction coefficient assumes a value inversely proportional to that of the flow rate of evaporative fuel. Therefore, if the output from the mass flowmeter assumes an excessively large value, the vapor flow rate-dependent correction coefficient becomes small to cause an insufficient amount of fuel injected, whereas if the output from the mass flowmeter assumes an excessively small value, the vapor flow rate-dependent correction coefficient becomes large to increase. the amount of fuel injected, resulting in a largely enriched total air-fuel mixture. In both of the cases, the driveability or performance of the engine is degraded.

SUMMARY OF THE INVENTION

It is the object of the invention to provide an evaporative fuel-purging control system for an internal combustion engine, which is capable of easily detecting abnormality of a flowmeter used in detection of the flow rate of an air-fuel mixture purged containing evaporative fuel.

To attain the object, the invention provides an evaporative fuel-purging control system for an internal combustion engine having a fuel tank and an intake passage, the evaporative fuel-purging control system including a canister for adsorbing evaporative fuel generated from the fuel tank, a purging passage connecting between the canister and the intake passage for purging a gaseous mixture containing the evaporative fuel therethrough into the intake passage, and a purge control valve arranged across the purging passage for controlling a flow rate of the evaporative fuel supplied to the intake passage through the purging passage.

According to a first aspect of the invention, the evaporative fuel-purging control system is characterized by comprising:

a flowmeter arranged across the purging passage for outputting an output value indicative of a flow rate of the gaseous mixture being purged through the purging passage;

purging flow rate-calculating means for calculating a value of the flow rate of the gaseous mixture flowing through the purging passage, based on a plurality of operating parameters of the engine;

purge control means for controlling an opening of the purge control valve, based on the output value from the flowmeter and the value of the flow rate calculated by the purging flow rate-calculating means; and abnormality-determining means for determining abnormality of the flowmeter, based on a value of the output value from the flowmeter assumed when the purging of the gaseous mixture is stopped.

Preferably, the abnormality-determining means determines that the flowmeter is abnormally functioning when the value of the output value from the flowmeter assumed when the purging of the gaseous mixture is interrupted is outside a predetermined tolerance range.

According to a second aspect of the invention, the evaporative fuel-purging control system is characterized by comprising:

a flowmeter arranged across the purging passage for outputting an output value indicative of a flow rate of the gaseous mixture being purged through the purging passage;

purging flow rate-calculating means for calculating a value of the flow rate of the gaseous mixture flowing through the purging passage, based on a plurality of operating parameters of the engine;

purge control means for controlling an opening of the purge control valve, based on the output value from the flowmeter and the value of the flow rate calculated by the purging flow rate-calculating means; and abnormality-determining means for determining abnormality of the flowmeter, based on a value of the output value from the flowmeter assumed when the purging of the gaseous mixture is resumed after stoppage thereof.

Preferably, the abnormality-determining means determines that the flowmeter is abnormally functioning when an amount of variation in the output value from the flowmeter between a value of the output value assumed when the purging of the gaseous mixture is stopped and a value of the output value assumed immediately after the purging of the gaseous mixture is resumed is smaller than a predetermined value.

In both the aspects of the invention, it is preferred that the flowmeter has an output characteristic which varies based on the concentration of the evaporative fuel in the gaseous mixture.

More preferably, the flowmeter is a mass flowmeter.

Further preferably, the mass flowmeter is a hot-wire type.

The above and other objects, features, and advantages of the invention will become more apparent from the ensuing detailed description taken in conjunction with the accompanying drawings.

DETAILED DESCRIPTION

The invention will now be described in detail with reference to the drawings showing embodiments thereof.

Figure 1:
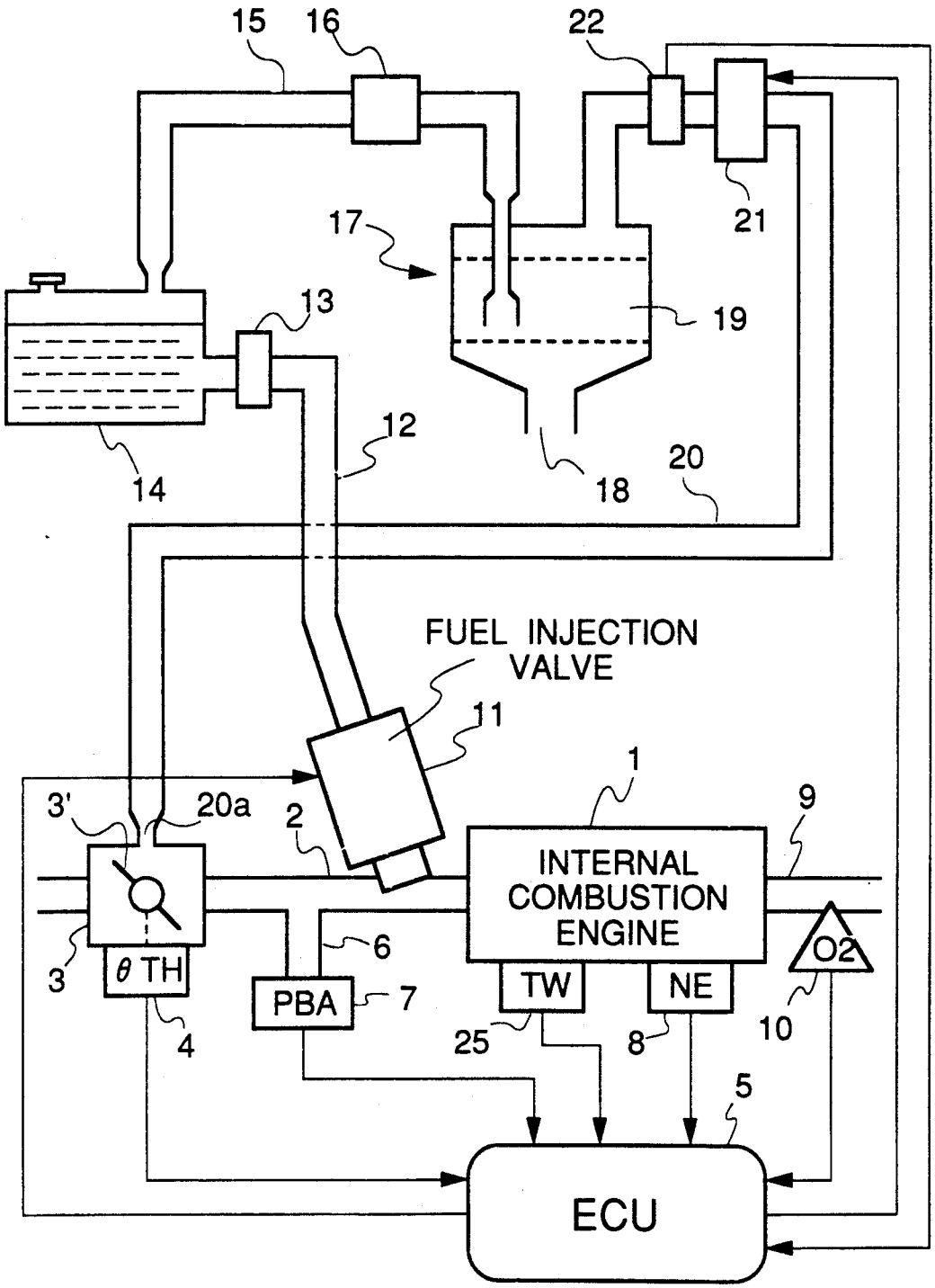
FIG. 1 is a block diagram showing the whole arrangement of an embodiment of the invention.

Referring first to FIG. 1, there is illustrated the whole arrangement of an evaporative fuel-purging control system of an internal combustion engine according to an embodiment of the invention.

In the figure, reference numeral 1 designates an internal combustion engine which is installed in an automotive vehicle, not shown. The engine is a four-cylinder type, for instance. Connected to the cylinder block of the engine 1 is an intake pipe 2 across which is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying same to an electronic control unit (hereinafter called "the ECU") 5.

Further, a branch conduit 6 is connected to the intake pipe 2 at a location downstream of the throttle valve 3'. Mounted at an end of the branch conduit 6 is an intake pipe absolute pressure (PBA) sensor 7 electrically connected to the ECU 5 for converting the sensed absolute pressure PBA into an electric signal indicative thereof and supplying same to the ECU 5.

An engine coolant temperature (TW) sensor 25, which may be formed from a thermistor or the like, is mounted in the coolant-filled cylinder block of the engine 1 for supplying an electric signal indicative of the sensed engine coolant temperature TW to the ECU 5.

An engine rotational speed (NE) sensor 8 (hereinafter referred to as "the NE sensor") is arranged in facing relation to a camshaft or a crankshaft of the engine 1, neither of which is shown.

The NE sensor generates a signal pulse (hereinafter referred to as "the TDC signal pulse") at a predetermined crank angle position whenever the crankshaft rotates through 180°, and the TDC signal pulse is supplied to the ECU 5.

An oxygen concentration sensor (hereinafter referred to as "the $O_2$ sensor") 10 is mounted in an exhaust pipe 9 for supplying an electric signal indicative of the sensed oxygen concentration in the exhaust gases to the ECU 5.

Fuel injection valves 11, only one of which is shown, are inserted into the interior of the intake pipe 2 at locations intermediate between the cylinder block of the engine 1 and the throttle valve 3' and slightly upstream of respective intake valves, not shown. The fuel injection valves 6 are connected to a fuel tank 14 via a fuel pump 13 by means of a fuel supply pipe 12, and electrically connected to the ECU 5 to have their valve opening periods controlled by signals therefrom.

A conduit 15 is mounted on a top of the fuel tank 14 for connecting the same to the canister 17 via a two-way valve 16. The canister 17 has an outside air-introducing port 18 and contains an adsorbent 19, (comprised of, for example, active carbon) for adsorbing and storing evaporative fuel flowing thereinto from the fuel tank 14.

Connected to the canister 17 is a purging conduit 20 which has an end thereof (i.e., PC port 20*a*) opening into the throttle body 3. The PC port 20*a* is located at such that it is positioned downstream of the throttle valve 3' when the throttle valve 3' is opened, whereas the PCT port 20*a* is positioned upstream of the throttle valve 3' when the latter is closed.

Mounted across the purging conduit 20 is a purge control valve 21 whose solenoid is connected to the ECU 5 and controlled by a signal supplied therefrom to change the valve opening linearly. That is, the ECU 5 supplies a control signal indicative of a control amount EPCV to the purge control valve 21 to control the opening thereof.

A mass flowmeter 22 is arranged across the purging conduit 20 at a location between the canister 17 and the purge control valve 21, which detects a flow rate of the mixture of evaporative fuel and air flowing in the purging conduit 20 and supplies a signal indicative of the detected flow rate to the ECU 5. The mass flowmeter 22 is a hot wire type which utilizes the nature of a platinum wire that when the platinum wire is heated by electric current applied thereto and at the same time exposed to a flow of gas, the platinum wire loses its heat to decrease in temperature so that its electric resistance decreases. Alternatively, it may be a thermo type comprising a thermistor of which the electric resistance varies due to self-heating by electric current applied thereto or a change in the ambient temperature. Both types of mass flowmeter detect variation in the concentration of evaporative fuel through variation in the electric resistance thereof.

The ECU 5 comprises an input circuit having the functions of shaping the waveforms of input signals from various sensors including the above-mentioned sensors, shifting the voltage levels of sensor output signals to a predetermined level, converting analog signals from analog-output sensors to digital signals, and so forth, a central processing unit (hereinafter referred to as "the CPU") which executes programs for calculating an evaporative fuel flow rate VQ, a purging flow rate TQ, and a vapor concentration $\beta$, referred to hereinafter, and the control amount EPCV, etc., memory means storing a Ti map, referred to hereinafter, and programs executed by the CPU and for storing results of calculations therefrom, etc., and an output circuit which outputs driving signals to the fuel injection valves 11 and the purge control valve 21.

The CPU operates in response to the above-mentioned engine parameter signals from the sensors to determine operating conditions in which the engine 1 is operating, such as an air-fuel ratio feedback control region in which the fuel supply is controlled in response to the detected oxygen concentration in the exhaust gases, and open-loop control regions, and calculates, based upon the determined operating conditions, the valve opening period or fuel injection period TOUT over which the fuel injection valves 11 are to be opened, by the use of the following equation (1) in synchronism with inputting of TDC signal pulses to the ECU 5:

$$TOUT = Ti \times KO_2 \times VQKO_2 \times K1 + K2 \quad (1)$$

where Ti represents a basic value of the fuel injection period TOUT (basic fuel amount) of the fuel injection valves 11, which is read from the Ti map in accordance with the engine rotational speed NE and the intake pipe absolute pressure PBA.

$KO_2$ represents an air-fuel ratio correction coefficient whose value is determined in response to the oxygen concentration in the exhaust gases detected by the $O_2$ sensor 10, during air-fuel ratio feedback control, while it is set to respective predetermined appropriate values while the engine is in predetermined operating regions (the open-loop control regions) other than the feedback control region.

$VQKO_2$ is a vapor (evaporative fuel) flow rate-dependent correction coefficient which is set according to a vapor flow rate (flow rate of evaporative fuel) detected during purging of the evaporative fuel.

K1 and K2 represent other correction coefficients and correction variables, respectively, which are calculated based on various engine parameter signals to such values as to optimize operating characteristics of the engine such as fuel consumption and accelerability depending on operating conditions of the engine.

The CPU supplies through the output circuit, the fuel injection valves 11 with driving signals corresponding to the fuel injection period TOUT calculated as above, over which the fuel injection valves 11 are opened.

According to the evaporative fuel-purging control system thus constructed, evaporative fuel or fuel vapor (hereinafter referred to as "evaporative fuel") generated within the fuel tank 14 forcibly opens a positive pressure valve, not shown, of the two-way valve 16 when the pressure of the evaporative fuel reaches a predetermined level, to flow through the valve 16 into the canister 17, where the evaporative fuel is adsorbed by the adsorbent 19 in the canister and thus stored therein. The purge control valve 21 is closed when its solenoid is not energized by the control signal from the ECU 5, whereas when the solenoid is energized, the valve 21 is opened to an extent corresponding to a degree of energization (i.e., the current amount of the control signal). That is, the ECU 5 supplies the control signal indicative of the control amount EPCV to the purge control valve 21 according to the output from the hot-wire type mass flowmeter 22, to thereby cause the purge control valve 21 to open to an extent corresponding to the control amount EPCV.

Accordingly, negative pressure in the intake pipe 2 causes evaporative fuel temporarily stored in the canister 17 to flow therefrom together with fresh air introduced through the outside air-introducing port 18 of the canister 17 at the flow rate determined by the valve opening of the purge control valve 21 corresponding to the current amount of the control signal applied thereto, through the purging conduit 17 into the intake pipe 2 to be supplied to the cylinders.

When the fuel tank 14 is cooled due to low ambient temperature, etc. so that negative pressure increases within the fuel tank 14, a negative pressure valve, not shown, of the two-way valve 16 is opened to return part of the evaporative fuel stored in the canister 17 into the fuel tank 14.

Next, with reference to FIGS. 2 to 7, description will be made of a manner of calculating a flow rate VQ of evaporative fuel to be purged (hereinafter referred to as "the vapor flow rate"), a flow rate TQ of an air-fuel mixture to be purged (hereinafter referred to as "the purging flow rate"), and concentration $\beta$ of the evaporative fuel in the air-fuel mixture purged (hereinafter referred to as "the vapor concentration").

Figure 2:
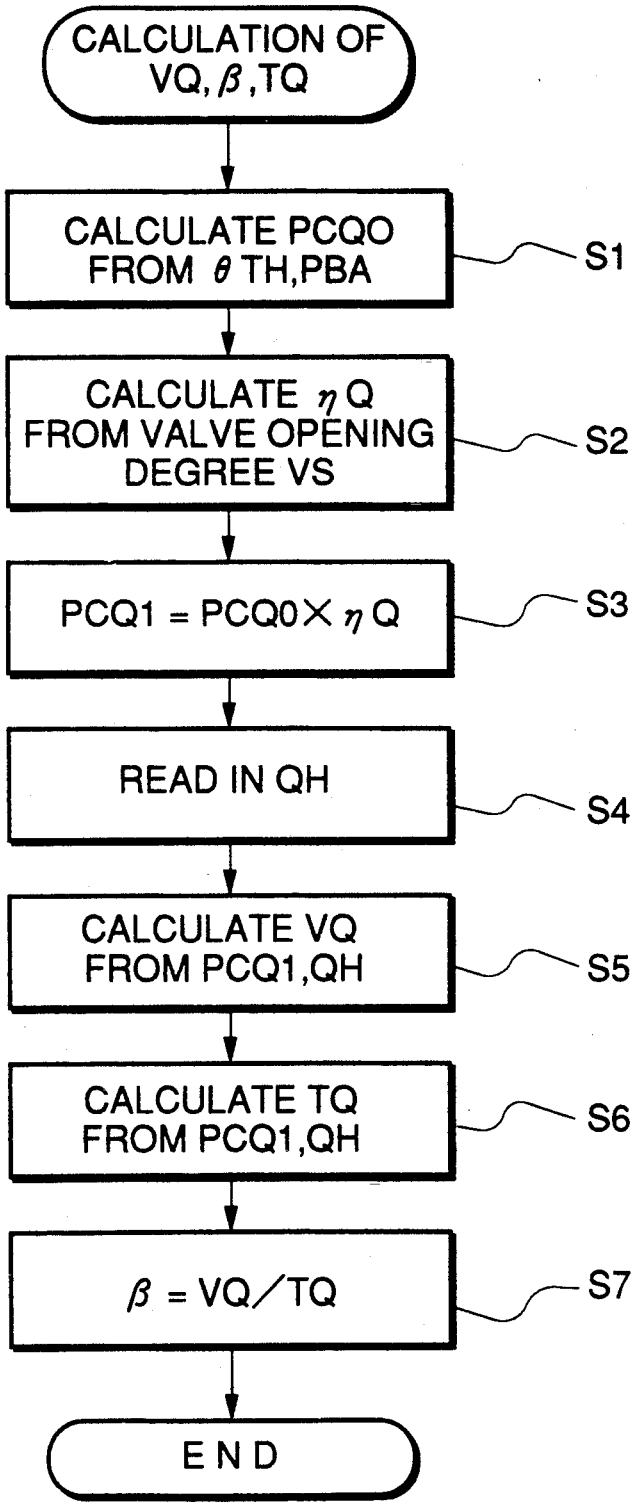
FIG. 2 is a flowchart showing a program of calculating a vapor flow rate VQ, a purging flow rate TQ, and a vapor concentration $\beta$.

FIG. 2 shows a program of calculating the vapor flow rate VQ, the purging flow rate TQ, and the vapor concentration $\beta$, which is executed by the CPU of the ECU 5.

First, at a step S1, a basic PC flow rate PCQ0, which is a basic value of a PC flow rate PCQ1, is calculated according to the throttle valve opening $\theta$TH and the intake pipe absolute pressure PBA.

The term "PC flow rate", used herein, means a flow rate of a mixture of evaporative fuel and air, which is calculated according to the throttle valve opening $\theta$TH and the intake pipe absolute pressure PBA. The PC flow rate PCQ1 is equal to an output value QH from the hot-wire type mass flowmeter 22 only when the vapor concentration $\beta$ is 0%, while when the vapor concentration is not 0%, the former is maintained in predetermined relationship with the latter, as hereinafter described.

Further, the basic PC flow rate PCQ0 represents a value of the PC flow rate assumed when the purge control valve 16 is fully open. The value of the PC basic flow rate PCQ0 is calculated by retrieving a PCQ0 map in which values of PCQ0 are set corresponding to predetermined values of the throttle valve opening $\theta$TH and ones of the intake pipe absolute pressure PBA, and by interpolation, if necessary.

Figure 3:
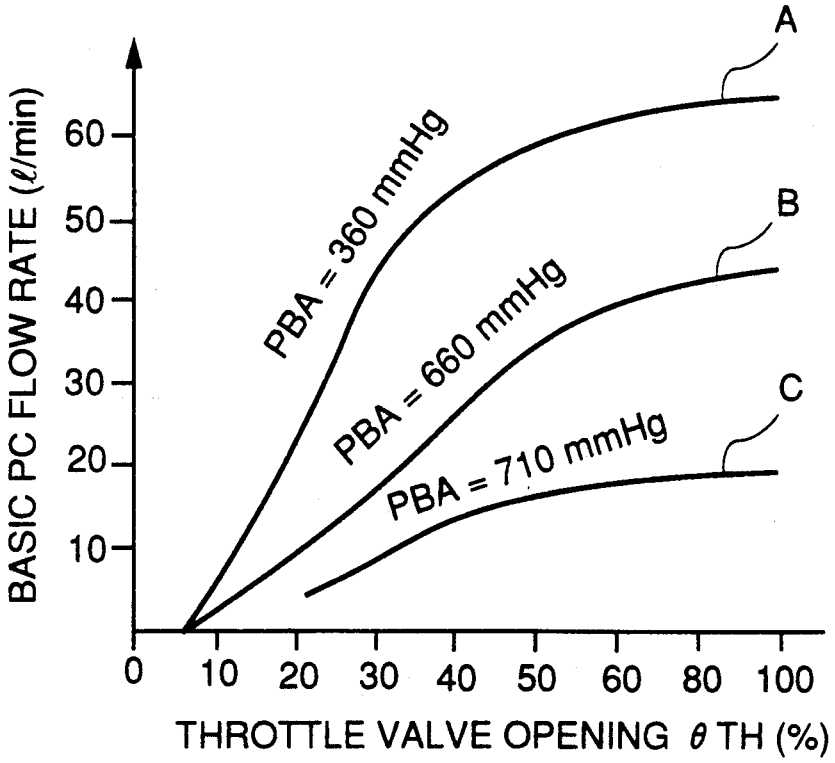
FIG. 3 is a graph showing the relationship between throttle valve opening $\theta$TH, intake pipe absolute pressure PBA, and a basic flow rate PCQ0.

FIG. 3 shows an example of the relationship between the throttle valve opening $\theta$TH and the intake pipe absolute pressure PBA, and the basic PC flow rate PCQ0.

In the figure, the abscissa represents the throttle valve opening $\theta$TH (%), and the ordinate the basic PC flow rate PCQ0 (l/min), with curves A, B, and C indicating, respectively, characteristics of the basic PC flow rate PCQ0 exhibited when the intake pipe absolute pressure PBA assume respective values of 360 mmHg, 660 mmHg, and 710 mmHg.

As is clear from the figure, the basic PC flow rate PCQ0 assumes smaller values as the intake pipe absolute pressure PBA is smaller, and as the throttle valve opening $\theta$TH is larger.

Then, the program proceeds to a step S2, where a flow rate ratio $\eta$Q is calculated according to the valve opening degree VS (%) of the purge control valve 21. The flow rate ratio $\eta$Q indicates a ratio of the PC flow rate PCQ1 to the basic flow rate PCQ0, corresponding to the valve opening degree VS (%) of the purge control valve 21. Specifically, a value of the flow rate ratio $\eta$Q is calculated by retrieving a $\eta$Q map in which values thereof are set corresponding to predetermined values of the valve opening degree VS, and by interpolation, if required.

Figure 4:
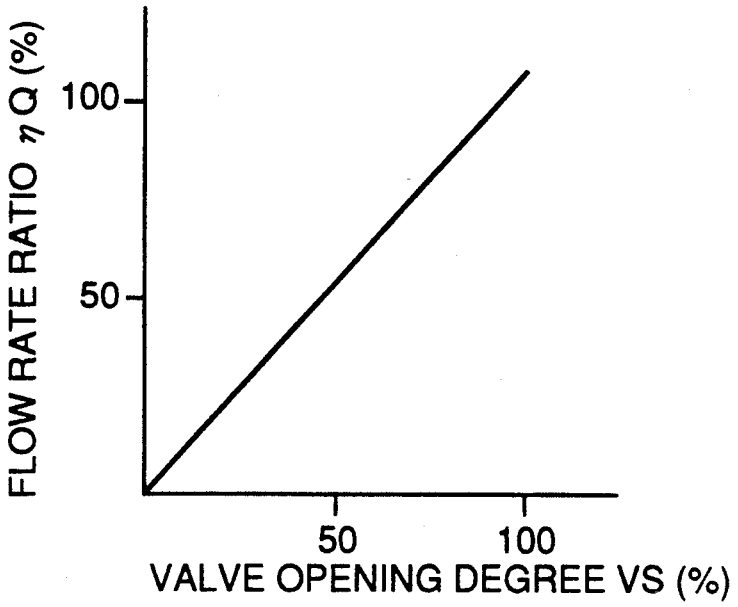
FIG. 4 is a graph showing a flow rate characteristic of a purge control valve.

FIG. 4 shows the relationship in characteristic between the flow rate ratio $\eta$Q and the valve opening degree VS. In the figure, the abscissa represents the valve opening degree VS (%), and the ordinate the flow rate ratio $\eta$Q.

As is clear from the figure, the flow rate ratio $\eta$Q is proportional to the valve opening degree VS.

Then, at a step S3, the PC flow rate PCQ1 is calculated by the use of the following equation (2):

$$PCQ1 = PCQ0 \times \eta Q \quad (2)$$

Then, at a step S4, the output value QH from the hot-wire type mass flowmeter 22 is read, and subsequently at a step S5, the vapor flow rate VQ is calculated by retrieving a value thereof from a VQ map according to the QH value and PCQ1 value, and by interpolation, if required. In the VQ map, values of the vapor flow rate VQ are set corresponding to predetermined values of the output value QH and ones of the PC flow rate PCQ1.

At a step S6, a value of the purging flow rate TQ is calculated by retrieving a value thereof from a TQ map, and by interpolation, if required, according to the QH value and the PCQ1 value. In the TQ map, similarly to the VQ map, values of the purging flow rate TQ are set corresponding to predetermined values of the output value QH and ones of the PC flow rate PCQ1.

Finally, at a step S7, the vapor concentration $\beta$ is calculated by the use of the following equation (3), followed by terminating the present program:

$$\beta = VQ/TQ \quad (3)$$

Figure 5:
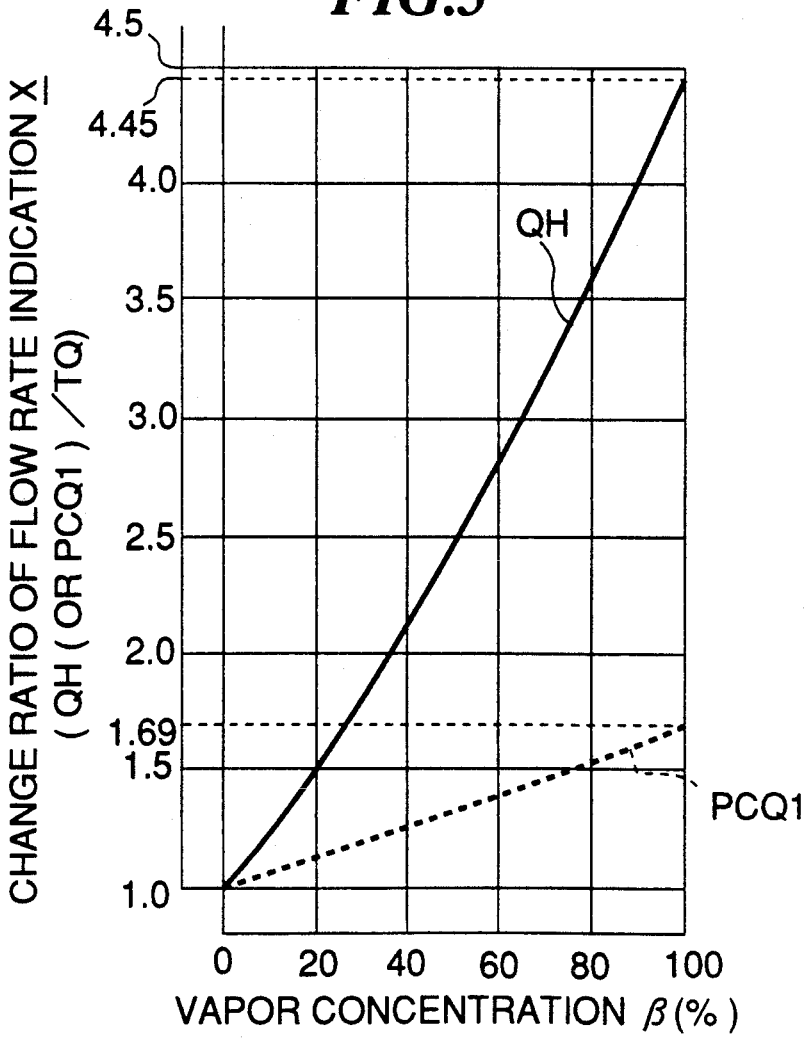
FIG. 5 is a graph showing the relationship between the vapor concentration $\beta$ and a change ratio of flow rate indication.
Figure 6A:
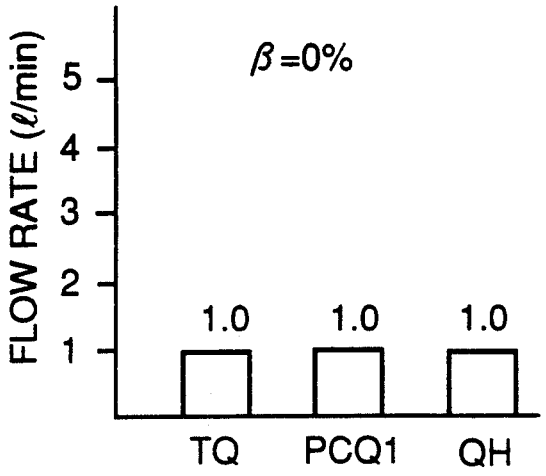
FIG. 6*a* is a graph useful in explaining the relationship between a purging flow rate TC, a PC flow rate PCQ1 and an output value QH from a hot wire-type mass flowmeter.
Figure 6B:
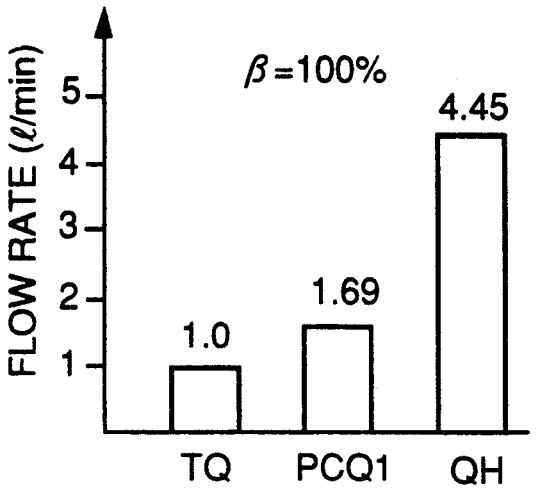
FIG. 6*b* is another graph useful in explaining the relationship between the purging flow rate TC, the PC flow rate PCQ1 and the output value QH from the hot wire-type mass flowmeter.

FIG. 5 shows the relationship between the vapor concentration $\beta$ in the mixture and a change ratio $\underline{x}$ of flow rate indication. In the figure, the solid line curve represents the output value QH of the hot-wire type mass flowmeter 22, and the broken line the PC flow rate PCQ1. The change ratio $\underline{x}$ of flow rate indication represents the ratio of an indicated flow rate value (i.e. the QH value or the PCQ1 value) obtained when $\beta > 0\%$ to one obtained whem $\beta = 0\%$, provided that the purging flow rate TQ is held constant. In other words, the change ratio $\underline{x}$ of flow rate indication represents the ratio of the QH value or the PCQ1 value to the purging flow rate TQ, i.e. $\theta$H/TQ or PCQ1/TQ. For example, when $\beta = 0\%$, the relationship of PCQ1=QH=TQ=1 (l/min) holds, as shown in FIG. 6*a*, whereas when $\beta = 100\%$, the relationships of PCQ1=1.69 (l/min) and QH=4.45 (l/min) hold while TQ=1 (l/min), as shown in FIG. 6*b*.

Figure 7:
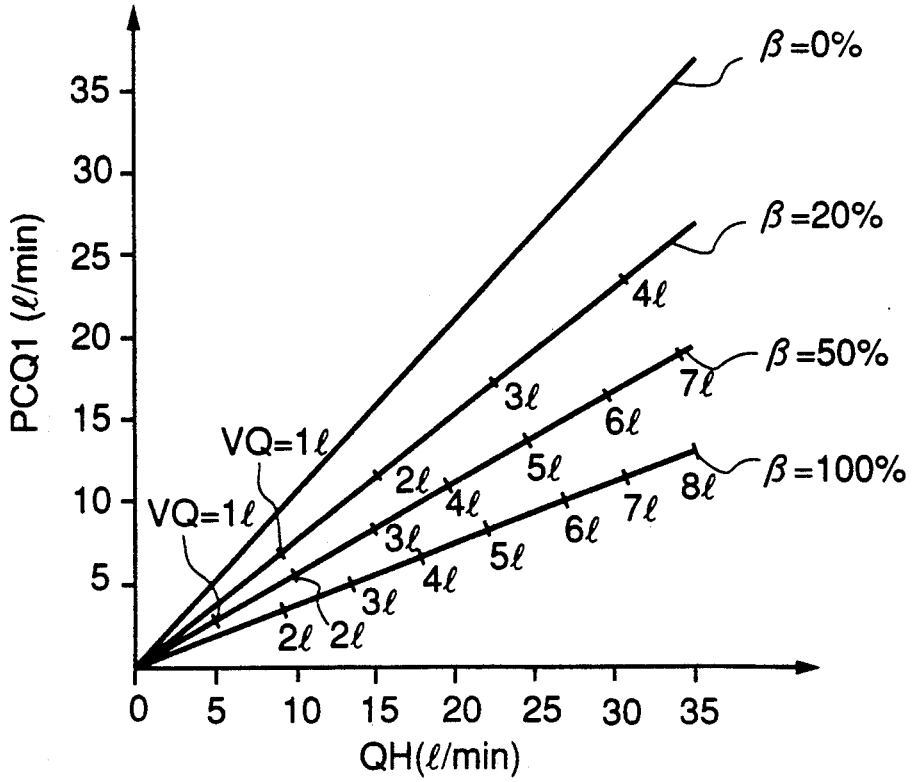
FIG. 7 is a graph useful in explaining the relationship between the PC flow rate PCQ1, the output value QH from the hot wire-type mass flowmeter, the vapor concentration $\beta$ and the vapor flow rate VQ.

FIG. 7 shows the relationship between the output value QH from the hot-wire type mass flowmeter 22, the PC flow rate PCQ1, the vapor concentration $\beta$, and the vapor flow rate VQ, in which values of the vapor concentration $\beta$ and ones of the vapor flow rate VQ are plotted with respect to the QH value and the PCQ1 value. Further, since the vapor concentration $\beta = VQ/TQ$, the purging flow rate TQ can be obtained by calculation by the use of the equation $TQ = VQ/\beta$.

Therefore, by the use of the relationship of FIG. 7, the vapor concentration $\beta$, the vapor flow rate VQ, and the purging flow rate TQ can be calculated according to the PC flow rate PCQ1 and the output value QH from the hot-wire type mass flowmeter 22.

FIG. 18 shows a program for calculating the vapor flow rate-dependent correction coefficient $VQKO_2$ and the control amount EPCV for controlling the opening of the purge control valve 21. This program is executed by the CPU of the ECU 5. The vapor flow rate-dependent correction coefficient $VQKO_2$ is used for correcting the air-fuel ratio correction coefficient $KO_2$ in response to the vapor flow rate VQ, while the control amount EPCV is a control parameter value for controlling the valve opening degree VS of the purge control valve 16. As the control amount EPCV increases, the opening of the purge control valve increases, which results in an increase in the vapor flow rate VQ.

Figure 8:
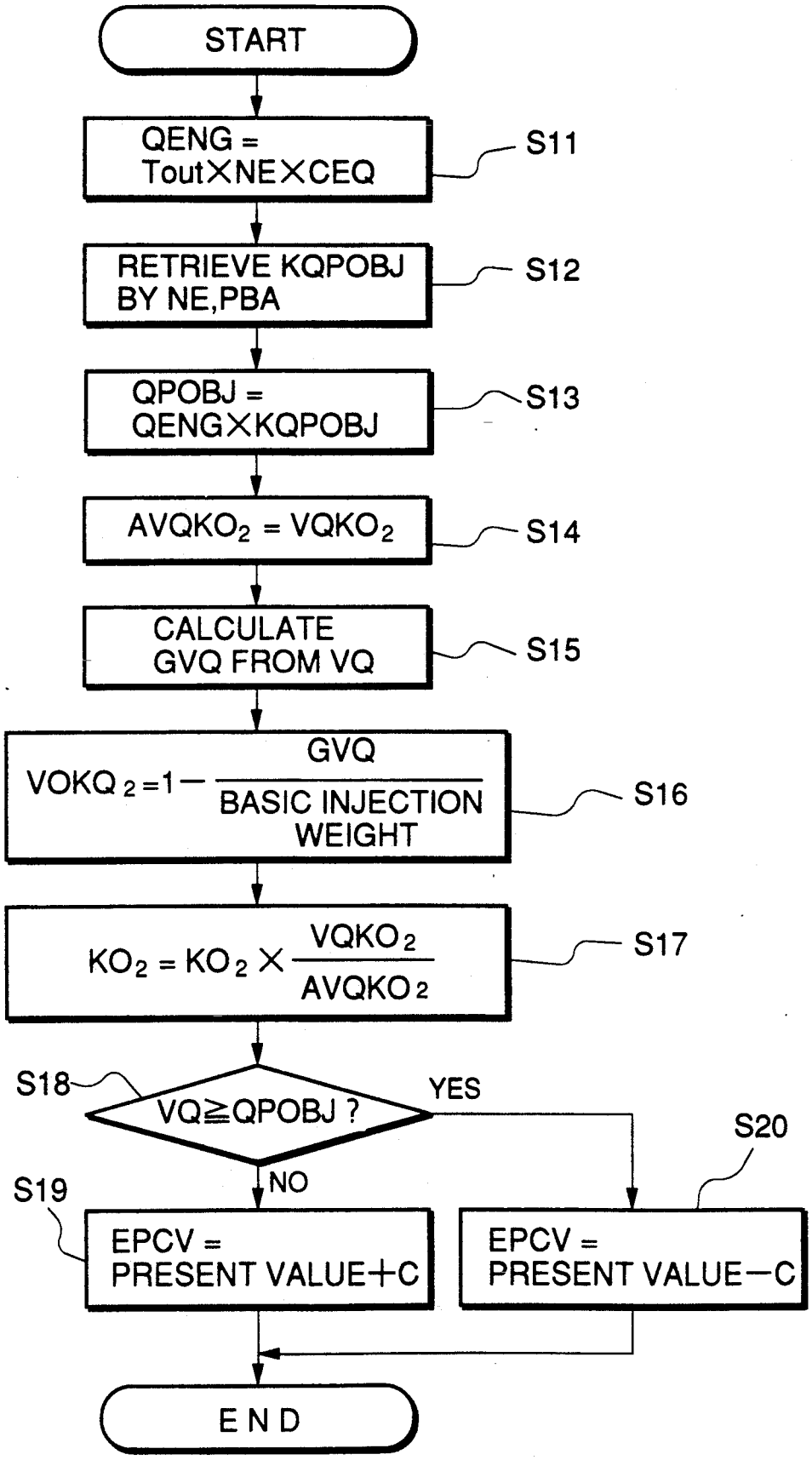
FIG. 8 is a flowchart of a program for controlling purge control valve opening and a fuel supply amount in response to the vapor flow rate VQ.

First, at a step S11 in FIG. 8, a flow rate QENG of air drawn into the engine 1 or intake air is calculated by the use of the following equation (4):

$$QENG = TOUT \times NE \times CEQ \quad (4)$$

where TOUT represents the fuel injection period calculated by the equation (1), referred to hereinbefore, and CEQ a constant for converting the product of TOUT×NE to the flow rate QENG of intake air.

At a step S12, a desired ratio KQPOBJ of the vapor flow rate to the flow rate QENG of intake air supplied to the engine is calculated from a KQPOBJ map according to the detected engine rotational speed NE and intake pipe absolute pressure PBA. The KQPOBJ map is set such that values of the desired ratio KQPOBJ are set corresponding, respectively, to combinations of a plurality of predetermined values of the engine rotational speed NE and a plurality of predetermined values of the intake pipe absolute pressure PBA.

At a step S13, a desired vapor flow rate QPOBJ is calculated by applying the flow rate QENG of intake air and the desired ratio KQPOBJ to the following equation (5):

$$QPOBJ = QENG \times KOPOBJ \quad (5)$$

The desired vapor flow rate QPOBJ may be corrected depending on the engine coolant temperature TW.

At a step S14, an immediately preceding value of the vapor flow rate-dependent correction coefficient $VQKO_2$ is temporarily stored as a variable $AVQKO_2$ in order to use the value at a step S17, referred to hereinafter.

At a step S15, the vapor flow rate VQ (l/min.) calculated by the program shown in FIG. 2 is converted to a gasoline weight-equivalent flow rate GVQ (g/min.) which is a flow rate expressed in terms of the weight of gasoline in liquid state per minute which is equivalent to the vapor flow rate VQ (l/min.) expressed in terms of the volume of vapor per minute, by the use of the following equation (5):

$$GVQ = (VQ/VMOL) \times \text{molecular weight of gasoline vapor} \quad (5)$$

where VMOL represents a value of molar volume of one mole of molecules, which is conveniently indicated by 22.4 l/min. to be assumed at a temperature of 0° C. The molecular weight of the gasoline vapor is approx. 64.

At a step S16, the gasoline weight-equivalent flow rate GVQ (g/min.) thus obtained is applied to the following equation (7) to calculate the vapor flow rate-dependent correction coefficient $VQKO_2$:

$$VQKO_2 = 1 - (GVQ/\text{basic injection weight}) \quad (7)$$

where the basic injection weight is a value obtained by converting the basic value Ti of the fuel injection period TOUT to the weight of fuel injected per unit time (minute).

The vapor flow rate-dependent correction coefficient $VQKO_2$ thus obtained assumes a value of 1.0 when the purge control valve 21 is closed, and a value lower than 1.0 when the purge control valve 21 is open to carry out purging of evaporative fuel.

At a step S17, the air-fuel ratio correction coefficient $KO_2$ is modified by the following equation (8):

$$KO_2 = KO_2 \times VQKO_2/AVQKO_2 \quad (8)$$

The modified $KO_2$ value is applied to the equation (1) to calculate the fuel injection period, whereby fuel is supplied to the engine 1 via the fuel injection valve 11 in amounts controlled so as to prevent fluctuations in the air-fuel ratio caused by variations in the purged amount of evaporative fuel.

Further, at a step S18, it is determined whether or not the vapor flow rate VQ obtained at the step S13 is equal to or larger than the desired vapor flow rate QPOBJ obtained at the step S13.

If the answer to the question of the step S18 is negative (NO), i.e. if the calculated vapor flow rate VQ is smaller than the desired vapor flow rate QPOBJ, the control amount EPCV determining the opening of the purge control valve 21 is increased from the present value by a predetermined value C at a step S19, to thereby increase the vapor flow rate, causing the evaporative emission control system to suppress emission of evaporative fuel to an increased extent, followed by terminating the program. The predetermined value C is a constant for renewal of the value of EPCV. On the other hand, if the answer to the question of the step S18 is affirmative (YES), i.e. if the calculated vapor flow rate VQ is equal to or larger than the desired vapor flow rate QPOBJ, the control amount EPCV is decreased from the present value by the predetermined value C at a step S20, to thereby reduce the vapor flow rate and hence prevent degradation in the responsiveness in the air-fuel ratio feedback control, followed by terminating the program.

In the above described manner, the actual vapor flow rate VQ is calculated, based on the fuel injection period TOUT is corrected (step S17) to thereby prevent fluctuations in the air-fuel ratio caused by purging of evaporative fuel, and at the same time the opening of the purge control valve 21 is controlled depending on the calculated vapor flow rate (steps S19, S20) to thereby prevent the average value of the air-fuel ratio correction coefficient from being largely deviated from a value of 1.0. This makes it possible to prevent degradation in the responsiveness in the air-fuel ratio feedback control which may occur when the average value, which is used as an initial value of the air-fuel ratio correction coefficient $KO_2$ upon transition of the air-fuel ratio control from the open-loop mode to the feedback control mode, is largely deviated from the value of 1.0.

In the evaporative fuel-purging control system described heretofore, it is possible to prevent fluctuations in the air-fuel ratio caused by the purging of the evaporative fuel, when the hot-wire type mass flowmeter 22 is normally operating. However, when the operation of the flowmeter 22 is abnormal due to failure thereof, etc., it does not supply a normal value to the ECU 5, which brings about fluctuations in the air-fuel ratio, resulting in degraded driveability of the engine, as described in detail in the background of the invention.

Therefore, according to the present invention, it is determined whether or not the flowmeter 22 is normally functioning, based on a value of the output value QH from the flowmeter 22 assumed when the supply of evaporative fuel to the intake system is cut off (e.g., when the purge control valve 21 or the throttle valve 3' is fully closed). That is, when the purging of the evaporative fuel is stopped, the vapor concentration $\beta$ in the vicinity of the flowmeter 22 is substantially equal to 0, so that QH=PCQ1 (this relationship is held when $\beta=0$, as described hereinbefore) (see FIG. 7). Therefore, whether or not the hot-wire type mass flowmeter 22 is normally functioning can be determined based on whether or not the output value QH from the flowmeter 22 assumed when the purging is stopped is within a predetermined tolerance, from the fact that the relationship of QH=PCQ1 should hold when the vapor concentration $\beta$ is 0%.

Figure 9:
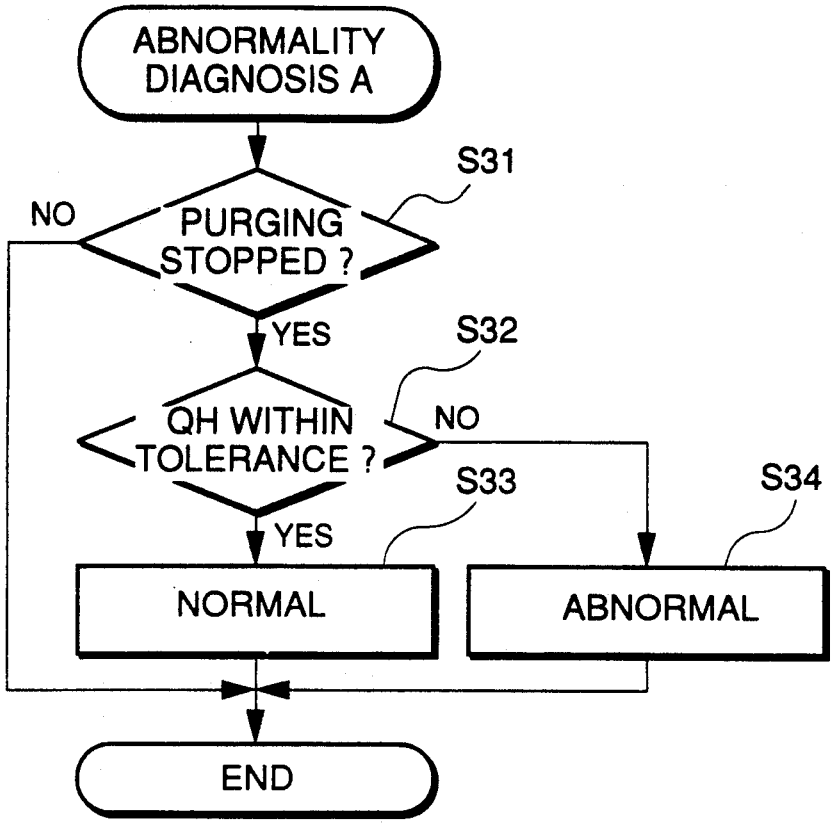
FIG. 9 is a flowchart of an abnormality diagnosis program A for detecting abnormality of the flowmeter.

FIG. 9 shows a program for executing an abnormality diagnosis A for determining whether or not the hot-wire type mass flowmeter 22 is normally functioning, which is executed by the CPU of the ECU 5.

First, at a step S31, it is determined whether or not the purging of the evaporative fuel is interrupted. More specifically, it is determined whether or not purging of evaporative fuel into the intake pipe 2 is stopped, by determining whether or not the purge control valve 21 or the throttle valve 3' is fully closed.

If the answer to this question is negative (NO), the program is immediately terminated.

On the other hand, if the answer to the question of the step S31 is affirmative (YES), it is determined at a step S32 whether or not the output value QH from the flowmeter 22 is within a predetermined tolerance. This determination is carried out by determining whether or not the actual QH value from the flowmeter 22 assumed when the purging of evaporative fuel is stopped (i.e. $\beta \approx 0$) is within a predetermined tolerance (i.e., $\pm 5\%$) of a predetermined value of the QH value memorized in the memory means as one corresponding to PCQ1=0, $\beta=0$ (i.e., QH=0, see FIG. 7). This is because under the condition of purging being stopped (purging flow rate=0, and hence vapor concentration $B \approx 0$), the most reliable abnormality detection can be achieved by comparing the actual output value QH from the flowmeter 22 with the predetermined memorized value thereof (=0).

If the answer to this question is affirmative (YES), it is judged at a step S33 that the flowmeter 22 is normally functioning, followed by terminating the program, whereas if the answer to this question is negative (NO), it is judged at a step S34 that the functioning of the flowmeter 22 is abnormal, followed by terminating the program. Thus, an abnormality diagnosis of the flowmeter 22 is carried out.

Further, the evaporative fuel-purging control system according to the invention is also provided with abnormality determining means for determining whether or not the hot-wire type mass flowmeter 22 is normally functioning based on a QH value from the flowmeter 22 when the supply of the evaporative fuel to the intake system is resumed after stoppage thereof.

More specifically, a value of the output value QH from the flowmeter 22 is continually read into the memory means of the ECU 5. When an amount of variation $\Delta$QH in the output value QH assumed immediately after resumption of purging or supply of the evaporative fuel is deviated by a predetermined amount or more from a predetermined normal value, it is determined that the functioning of the hot-wire type mass flowmeter 22 is abnormal. More specifically, when the amount of variation $\Delta$QH is smaller than a predetermined value, it is determined that the functioning of the flowmeter 22 is abnormal. Preferably, the predetermined normal value can be set according to time elapsed after the resumption of purging.

Figure 10:
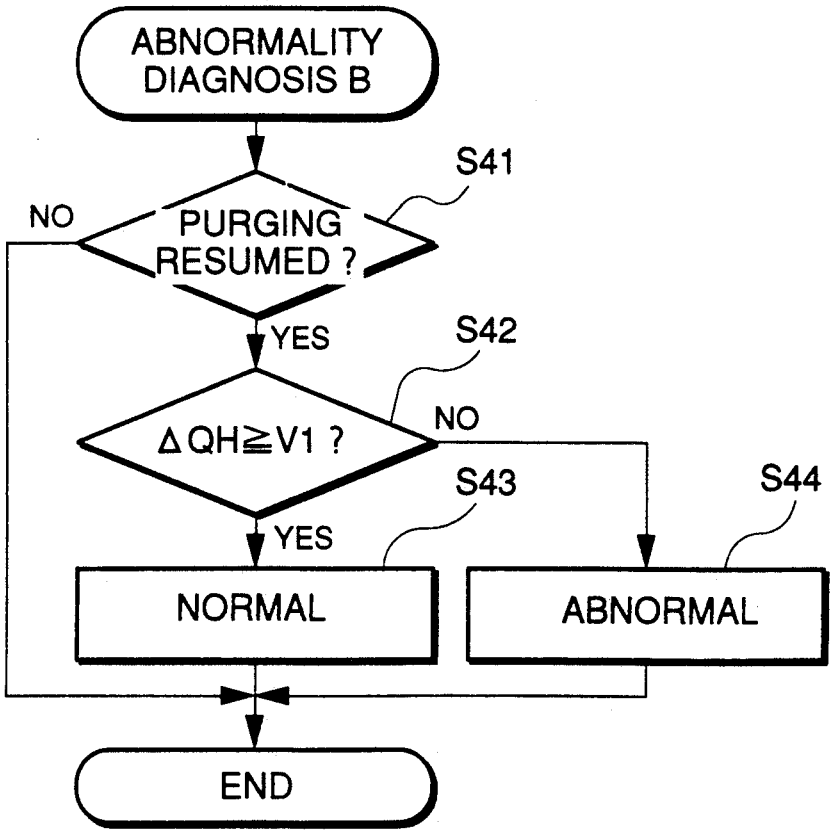
FIG. 10 is a flowchart of an abnormality diagnosis program B for detecting abnormality of the flowmeter.

FIG. 10 shows a program for executing the abovementioned abnormality diagnosis B for determining whether or not the flowmeter 22 is normally functioning, which is executed by the CPU of the ECU 5.

First, at a step S41, it is determined whether or not the purging of the evaporative fuel has been resumed after stoppage thereof.

If the answer to this question is negative (NO), the program is immediately terminated.

On the other hand, if the answer to the question of the step S41 is affirmative (YES), it is determined at a step S42 whether or not the output variation $\Delta$QH from the flowmeter 22 is equal to or larger than a predetermined amount V1.

If the answer to this question is affirmative (YES), it is determined at a step S43 that the flowmeter 22 is normally functioning, followed by terminating the program, whereas if the answer is negative (NO), it is determined at a step S44 that the flowmeter 22 is abnormally functioning, followed by terminating the program.

Thus, according to the evaporative fuel-purging control system of the invention, it is possible to easily detect abnormality of the flowmeter 22, which enables to promptly cope with an abnormality of the flowmeter 22 due to a defect or aging deterioration, upon occurrence thereof.

Figure 11:
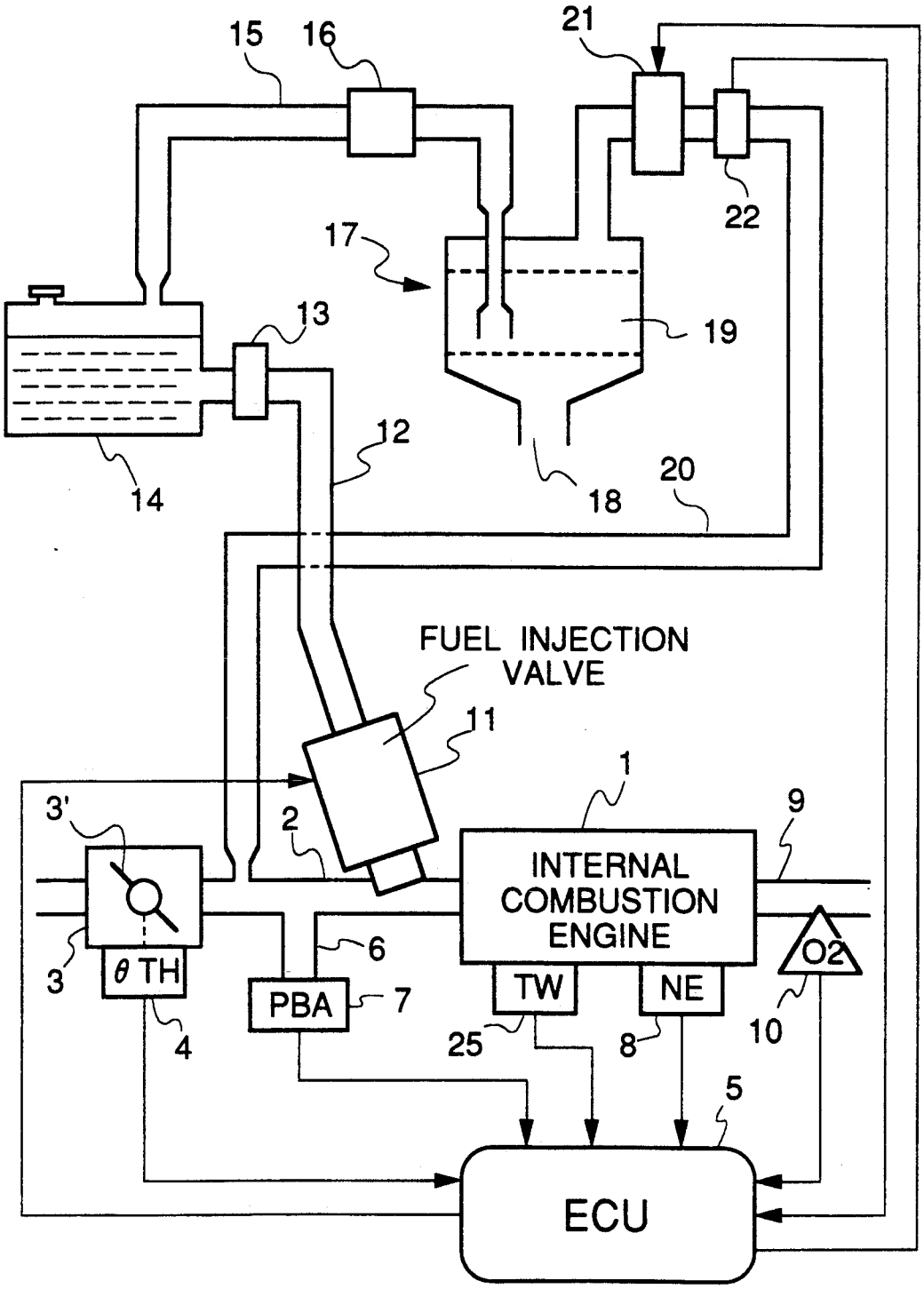
FIG. 11 is a block diagram showing the whole arrangement of another embodiment of the invention.

This invention is not limited to the embodiment described above, but as shown in FIG. 11, the system may be constructed such that the purge control valve 21 is interposed between the hot-wire type mass flowmeter 22 and the canister 17, and also one end of the purging conduit 20 opens into the intake pipe 2 at a location downstream of the throttle valve 3'.

What is claimed is:

1. In an evaporative fuel-purging control system for an internal combustion engine having a fuel tank and an intake passage, said evaporative fuel-purging control system including a canister for adsorbing evaporative fuel generated from said fuel tank, a purging passage connecting between said canister and said intake passage for purging a gaseous mixture containing said evaporative fuel therethrough into said intake passage, and a purge control valve arranged across said purging passage for controlling a flow rate of said evaporative fuel supplied to said intake passage through said purging passage, the improvement comprising:

a flowmeter arranged across said purging passage for outputting an output value indicative of a flow rate of said gaseous mixture being purged through said purging passage;

purging flow rate-calculating means for calculating a value of the flow rate of said gaseous mixture flowing through said purging passage, based on a plurality of operating parameters of said engine;

purge control means for controlling an opening of said purge control valve, based on said output value from said flowmeter and said value of the flow rate calculated by said purging flow rate-calculating means; and abnormality-determining means for determining abnormality of said flowmeter, based on a value of said output value from said flowmeter assumed when the purging of said gaseous mixture is stopped.

2. An evaporative fuel-purging control system according to claim 1, wherein said abnormality-determining means determines that said flowmeter is abnormally functioning when said value of said output value from said flowmeter assumed when the purging of said gaseous mixture is interrupted is outside a predetermined tolerance range.

3. In an evaporative fuel-purging control system for an internal combustion engine having a fuel tank and an intake passage, said evaporative fuel-purging control system including a canister for absorbing evaporative fuel generated from said fuel tank, a purging passage connecting between said canister and said intake passage for purging a gaseous mixture containing said evaporative fuel therethrough into said intake passage, and a purge control valve arranged across said purging passage for controlling a flow rate of said evaporative fuel supplied to said intake passage through said purging passage, the improvement comprising:

a flowmeter arranged across said purging passage for outputting an output value indicative of a flow rate of said gaseous mixture being purged through said purging passage;

purging flow rate-calculating means for calculating a value of the flow rate of said gaseous mixture flowing through said purging passage, based on a plurality of operating parameters of said engine;

purge control means for controlling an opening of said purge control valve, based on said output value from said flowmeter and said value of the flow rate calculated by said purging flow rate-calculating means; and abnormality-determining means for determining abnormality of said flowmeter, based on a value of said output value from said flowmeter assumed when the purging of said gaseous mixture is resumed after stoppage thereof.

4. An evaporative fuel-purging control system according to claim 3, wherein said abnormality-determining means determines that said flowmeter is abnormally functioning when an amount of variation in said output value from said flowmeter between a value of said output value assumed when the purging of said gaseous mixture is stopped and a value of said output value assumed immediately after the purging of said gaseous mixture is resumed is smaller than a predetermined value.

5. An evaporative fuel-purging control system according to claim 2 or 4, wherein said flowmeter has an output characteristic which varies in dependence on concentration of said evaporative fuel in said gaseous mixture.

6. An evaporative fuel-purging control system according to claim 5, wherein said flowmeter is a mass flowmeter.

7. An evaporative fuel-purging control system according to claim 6, wherein said mass flowmeter is a hot-wire type.

* * * * *